US007156169B2

(12) United States Patent
Bartlett

(10) Patent No.: US 7,156,169 B2
(45) Date of Patent: Jan. 2, 2007

(54) ELECTRICALLY OPERATED ACTUATION TOOL FOR SUBSEA COMPLETION SYSTEM COMPONENTS

(75) Inventor: Christopher D. Bartlett, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 118 days.

(21) Appl. No.: 10/740,164

(22) Filed: Dec. 17, 2003

(65) Prior Publication Data

US 2005/0133216 A1 Jun. 23, 2005

(51) Int. Cl.
*E21B 7/12* (2006.01)

(52) U.S. Cl. ..... 166/66.7; 166/338

(58) Field of Classification Search ..... 166/338, 166/267, 66.7, 65.1; 324/371
See application file for complete search history.

(56) References Cited

U.S. PATENT DOCUMENTS 2,965,837 A * 12/1960 Hawkins ..... 324/371
3,665,955 A 5/1972 Conner, Sr.
3,675,720 A 7/1972 Sizer
3,921,500 A 11/1975 Silcox
4,052,703 A * 10/1977 Collins et al. ..... 166/351
4,337,829 A 7/1982 Banzoli et al.
4,375,239 A 3/1983 Barrington et al.
4,391,330 A 7/1983 Kiefer
4,493,374 A 1/1985 Magee, Jr.
4,632,188 A 12/1986 Schuh et al.
4,796,708 A 1/1989 Lembcke
4,880,060 A 11/1989 Schwendemann et al.
5,070,944 A 12/1991 Hopper
5,088,558 A 2/1992 Mohn
5,188,180 A 2/1993 Jennings
5,320,182 A 6/1994 Mendez
5,404,946 A 4/1995 Hess
6,012,518 A 1/2000 Pringle et al.
6,068,053 A * 5/2000 Shaw ..... 166/267
6,216,784 B1 4/2001 Harrell
6,257,549 B1 7/2001 Hopper
6,318,457 B1 * 11/2001 Den Boer et al. ..... 166/66.7
6,343,654 B1 2/2002 Brammer
6,516,875 B1 2/2003 Reilly et al.
6,595,487 B1 7/2003 Johansen et al.
6,953,094 B1 * 10/2005 Ross et al. ..... 166/65.1
2003/0159829 A1 8/2003 Fripp et al.
2003/0161689 A1 8/2003 Emmett

FOREIGN PATENT DOCUMENTS

WO WO-00/0915 A2 1/2000

* cited by examiner

*Primary Examiner*—Jennifer H. Gay
*Assistant Examiner*—Matthew J. Smith
(74) *Attorney, Agent, or Firm*—Henry C. Query, Jr.

(57) ABSTRACT

An electrically operated actuation tool for a subsea completion system component having at least one hydraulically actuatable mechanism comprises an electric motor, a hydraulic pump which is driven by the motor and at least one hydraulic line which communicates between the hydraulic pump and a corresponding hydraulic conduit that is fluidly connected to the mechanism. In this manner, the motor drives the hydraulic pump to generate hydraulic pressure which is used to actuate the mechanism.

28 Claims, 6 Drawing Sheets

ELECTRICALLY OPERATED ACTUATION TOOL FOR SUBSEA COMPLETION SYSTEM COMPONENTS

BACKGROUND OF THE INVENTION

The present invention is directed to an actuation tool for subsea completion system components. More particularly, the invention is directed to an actuation tool which comprises an electrical actuator, such as a motor, for actuating a corresponding mechanism on the subsea completion system component.

Subsea completion systems typically comprise a wellhead housing which is located on the sea floor at the upper end of a well bore, a christmas tree which is secured to the top of the wellhead housing, and a tubing hanger which is landed in either the wellhead housing or the christmas tree and which supports a tubing string that extends through the well bore and into the subterranean well. Prior to installing the tubing hanger, a blowout preventer ("BOP") is usually connected to the top of the wellhead housing or the christmas tree and a low pressure riser pipe is connected between the BOP and a surface rig. The BOP provides a necessary barrier between the well bore and the environment and allows the riser pipe to be disconnected from the subsea completion system in the event of an emergency.

Numerous subsea completion system components include mechanisms which are actuated by hydraulic pressure that is supplied from the surface rig over an umbilical. One such component is a tubing hanger running tool ("THRT"), which is used to install the tubing hanger in the wellhead housing or the christmas tree. Prior art THRT's commonly include a cylindrical body and first and second generally tubular locking pistons which are slidably supported on the body. The first locking piston is adapted to engage a first locking device to secure the THRT to the tubing hanger, and the second locking piston is adapted to engage a second locking device to secure the tubing hanger to the wellhead housing or the christmas tree.

During installation of the tubing hanger, a running string is connected to the top of the THRT, the first locking piston is actuated to secure the THRT to the top of the tubing hanger, and the assembly is lowered to the subsea wellhead through the riser pipe and the BOP. Once the tubing hanger is landed, the second locking piston is actuated to secure the tubing hanger to the wellhead housing or the christmas tree and, when appropriate, the first locking piston is again actuated to release the THRT from the tubing hanger so that the THRT can be retrieved to the surface rig.

The first and second locking pistons are typically actuated by hydraulic pressure which is communicated to the THRT through an umbilical that extends from the surface rig. The lower end of the umbilical is often terminated in a slick joint which is located at the upper end of the BOP when the tubing hanger is landed in the wellhead housing or the christmas tree. The slick joint allows the BOP rams to close and seal around the running string or the THRT without interference from the umbilical.

Although the slick joint allows the BOP rams to form an effective seal without interference from the umbilical when the BOP is located subsea, several operators are exploring the possibility of mounting the BOP on the surface rig and connecting the BOP with the subsea completion system using a high pressure riser pipe. This arrangement requires that the THRT umbilical pass through the BOP rams, which may prevent the BOP rams from sealing adequately in the event of an emergency. A possible solution to this problem is to connect the umbilical to a special BOP spanner joint which is located adjacent the surface-mounted BOP. However, this requires that the umbilical be cut to an exact length to properly span the distance between the spanner joint and the subsea wellhead or christmas tree, and the use of such custom-length umbilicals for each subsea completion system is undesirable. Another solution is to employ composite riser pipe joints which incorporate hydraulic conduits for the THRT. However, these composite joints are time consuming to install and their hydraulic conduits are difficult to fill and flush.

SUMMARY OF THE INVENTION

In accordance with the present invention, these and other disadvantages in the prior art are overcome by providing an electrically operated actuation tool for a subsea completion system component which comprises at least one hydraulically actuatable mechanism. The actuation tool comprises an electric motor, a hydraulic pump which is driven by the motor, and at least one hydraulic line which communicates between the hydraulic pump and a corresponding hydraulic conduit that is fluidly connected to the mechanism. In this manner, the motor drives the hydraulic pump to generate hydraulic pressure which is used to actuate the mechanism.

In accordance with another embodiment of the present invention, the electrically operated actuation tool comprises a body which is releasably connectable to a deployment device, at least one hydraulically actuatable mechanism which is supported on the body and is designed to operatively engage the subsea completion system component, an electric motor, a hydraulic pump which is driven by the motor, and at least one hydraulic line which communicates between the hydraulic pump and the mechanism. Thus, the motor drives the hydraulic pump to generate hydraulic pressure which is used to actuate the mechanism and thereby cause the mechanism to operatively engage the subsea completion system component.

In accordance with a further embodiment of the present invention, an electrically operated THRT is provided for installing a tubing hanger in a wellhead or the like. The THRT comprises an elongated body which includes a first end that is position adjacent the tubing hanger and a second end that is connected to a running string, at least first and second locking pistons which are each movably supported on the body, and an electrically operated actuator for moving each of the first and second locking pistons between respective first and second unlocked and first and second locked positions. In the first locked position the first locking piston is engaged with a first locking device to secure the body to the tubing hanger. Also, in the second locked position the second locking piston is engaged with a second locking device to secure the tubing hanger to the wellhead.

The electrically operated actuator of this embodiment may comprise a first electric motor which is coupled to the first locking piston and a second electric motor which is coupled to the second locking piston. The first and second electric motors may be, for example, rotary motors, in which event the THRT preferably further comprises means for converting the rotary output of each of the first and second motors into axial translation of the corresponding first and second locking piston.

Alternatively, the electrically operated actuator may comprise an electric motor and a hydraulic pump which is driven by the motor. In this event, the motor drives the hydraulic pump to generate hydraulic pressure which is used to actuate the first and second locking pistons.

In each of the foregoing embodiments, the present invention may further comprise a power source for the motor, such as a battery which is located proximate the motor. In addition, the invention may comprise a control unit for controlling the operation of the motor. The control unit is preferably activated by control signals which are transmitted from a surface rig. In one embodiment of the invention, the control signals are transmitted wirelessly from the surface rig to the control unit.

Thus, the electrically operated actuation tool of the present invention does not require a hydraulic umbilical from a surface rig. In addition, since the actuation tool may be powered by a battery and controlled by a control unit which are both ideally located on the actuation tool, no need exists for any umbilicals or cables from the surface rig which could interfere with the sealing of the BOP rams.

These and other objects and advantages of the present invention will be made apparent from the following detailed description, with reference to the accompanying drawings. In the drawings, the same reference numbers may be used to denote similar components in the various embodiments.

DETAILED DESCRIPTION OF THE PREFERRED EMBODIMENTS

The electrically operated actuation tool of the present invention may be used in conjunction with a variety of subsea completion system components which comprise one or more actuatable mechanisms. In this regard, an actuatable mechanism may either be a discrete device or a cooperative device, that is, a device which is designed to operatively engage another subsea completion system component. One example of a discrete actuatable mechanism is a flow control valve. Examples of subsea completion system components which may comprise discrete actuatable mechanisms include tubing hangers, wellhead housings, christmas trees, spool trees, tree caps and flow control modules. Cooperative actuatable mechanisms may include, for example, locking pistons, locking pins, lockdown devices, energizing mandrels and penetrators. Examples of subsea completion system components which may comprise cooperative actuatable mechanisms include tubing hangers, wellhead housings, christmas trees, spool trees, tree caps, wellhead connectors and flowline connectors. Additional examples of subsea completion system components which may comprise cooperative actuatable mechanisms include the tools which are commonly employed to perform operations on any of the foregoing components, such as running tools, retrieval tools, intervention tools, override tools, seal replacement tools, torque tools, lifting tools, actuation tools and rotary tools.

In accordance with a first embodiment of the present invention, the electrically operated actuation tool comprises one or more electrical actuators which are incorporated into a subsea completion system component. In addition, instead of hydraulically actuated mechanisms, the subsea completion system component includes a number mechanisms which are similar in function but are actuated by the electrical actuators. Consequently, the actuation tool eliminates the need for a hydraulic umbilical from the surface rig to the subsea completion system component. Although the actuation tool of this embodiment may be incorporated into a variety of subsea completion system components, for simplicity sake it will be described hereafter in connection with a THRT.

Figure 1:
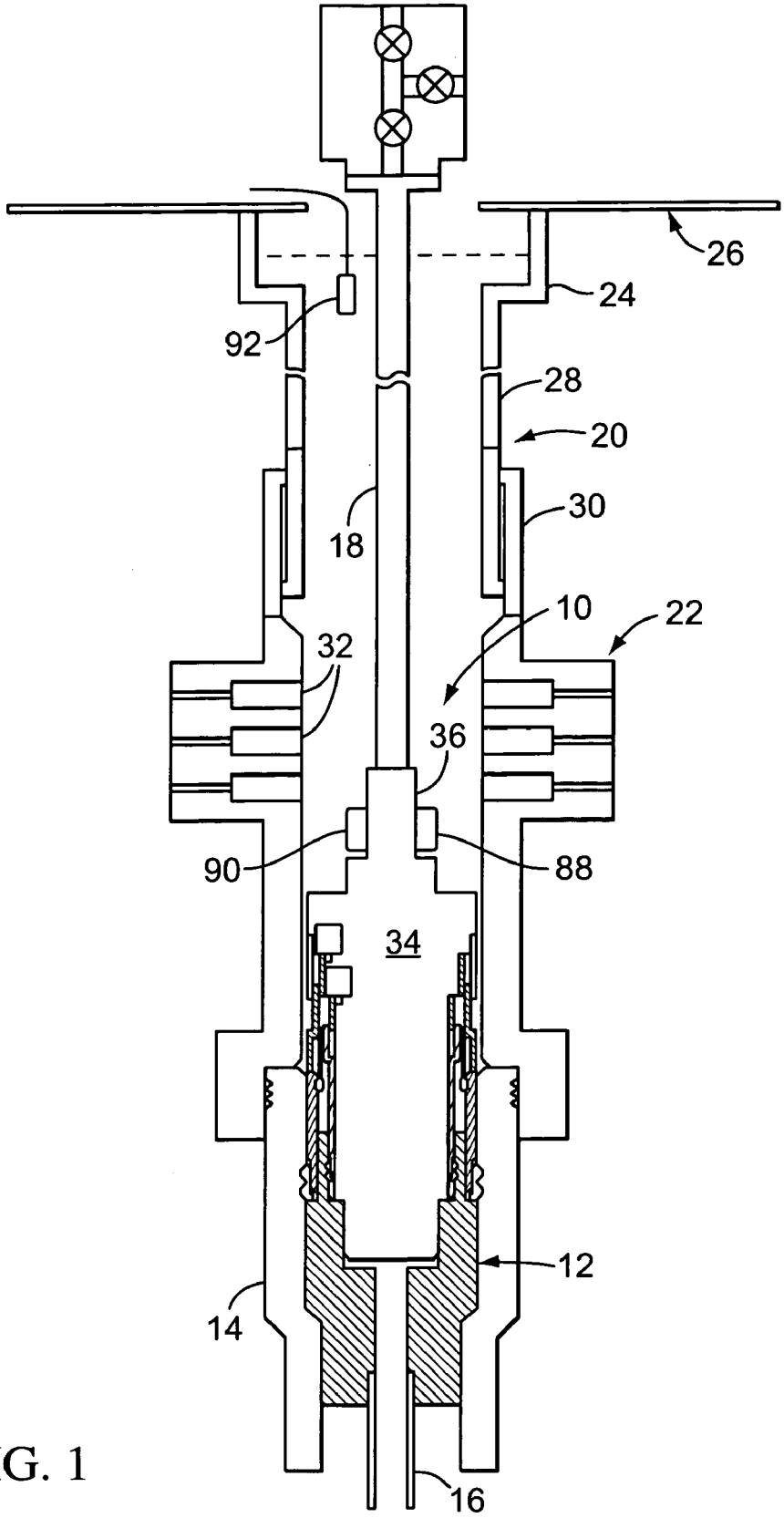
FIG. 1 is a representation of the electrically operated actuation tool of the present invention shown incorporated into a schematically-illustrated THRT which is being used to install a tubing hanger in an exemplary wellhead housing.

Thus, referring to FIG. 1, the electrically operated actuation tool is shown incorporated into a THRT, which is indicated generally by reference number 10. The THRT 10 is shown being used to install a tubing hanger 12 in a wellhead 14 that is located at the upper end of a subsea well bore. The tubing hanger 12 can be any of a variety of tubing hangers which are used to suspend a tubing string 16 in the well bore, and the wellhead 14 can be any component in which a tubing hanger may be supported, such as a wellhead housing, a tubing head, a tubing spool, a christmas tree or a spool tree. The THRT 10 is secured to the tubing hanger 12 in a manner which will be described below, and these components are lowered on a suitable running string 18 through a riser 20 and a BOP 22.

For purposes of illustration, the riser 20 is shown to comprise a diverter 24 which is connected to a surface rig 26, a low pressure riser string 28 which is connected to the diverter, and a slip joint 30 which is incorporated into the riser string between the diverter and the BOP 22. However, as will be readily understood by the person of ordinary skill in the art, the riser 20 may comprise other combinations of components that are arranged in various manners.

The BOP 22 includes a number of BOP rams 32 for sealing around the running string 18 and/or the THRT 10 in order to provide a pressure barrier between the well bore and the environment in the event one of the primary pressure barriers in the subsea completion system should fail. Although the BOP 22 is shown connected between the riser 20 and the wellhead 14, it could be located on the surface rig 26, in which event the riser would preferably comprise a high pressure riser string extending from the BOP to the wellhead 14.

Figure 2:
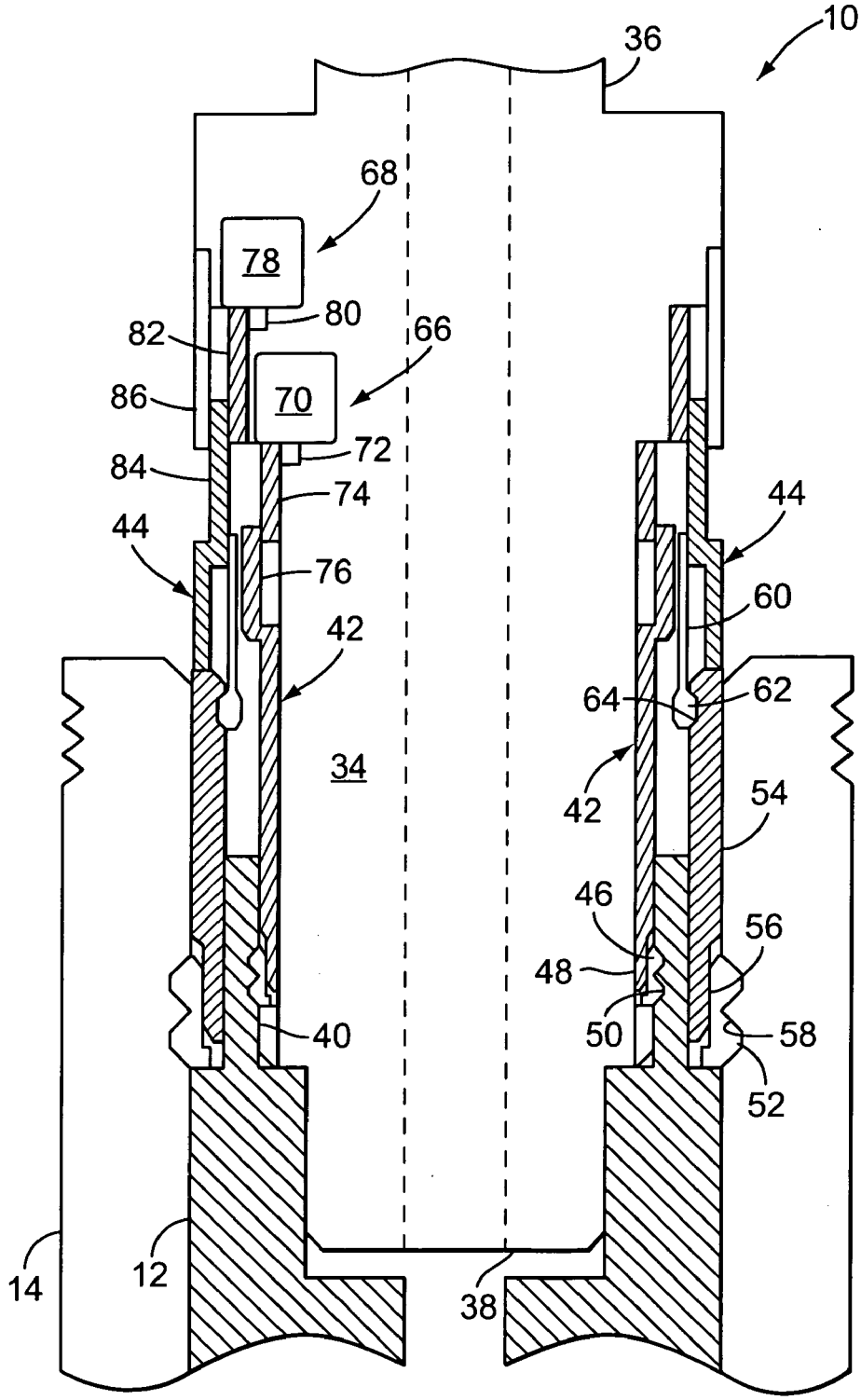
FIG. 2 is an enlarged cross sectional view of the THRT of FIG. 1 showing the first locking piston engaged with the first locking device to secure the THRT to the tubing hanger and the second locking piston engaged with the second locking device to secure the tubing hanger to the wellhead housing.

Referring to FIG. 2, the THRT 10 comprises an elongated, generally annular body 34 which includes an upper end 36 that is secured to the running string 18 such as by threads (not shown) and a lower end 38 that is ideally received within a receptacle 40 located in the top of the tubing hanger 12. The THRT 10 also comprises a first preferably cylindrical locking piston 42 which is slidably supported on the body 34 and is adapted to engage a first locking device to secure the THRT to the tubing hanger 12, and a second preferably cylindrical locking piston 44 which is slidably supported on the body and is adapted to engage a second locking device to secure the tubing hanger to the wellhead 14.

The first locking device can comprise any mechanism which operates to secure the body 34 to the tubing hanger 12. In the illustrative embodiment of the invention shown in FIG. 2, for example, the first locking device includes an expandable lock ring 46 which is supported on the THRT 10. When the first locking piston 42 is moved from an upper or unlocked position to the lower or locked position shown in FIG. 2, a cam ring 48 formed on or connected to the lower end of the first locking piston forces the lock ring 46 radially outwardly into a corresponding groove 50 in the receptacle 40 to thereby lock the THRT 10 to the tubing hanger 12.

The second locking device similarly can comprise any suitable mechanism which functions to secure the tubing hanger 12 to the wellhead 14. For example, the second locking device may comprise an expandable lock ring 52 which is adapted to be engaged by a locking mandrel 54 that is slidably supported on the tubing hanger 12. When the second locking piston 44 is moved from an upper or unlocked position to the lower or locked position shown in FIG. 2, the second locking piston forces the locking mandrel 54 downward, and a lower nose portion 56 of the locking mandrel forces the lock ring 52 radially outwardly into a corresponding lock groove 58 in the wellhead 14 to thereby secure the tubing hanger 12 to the wellhead.

If desired or required, the THRT 10 may also include suitable means to releasably connect the second locking piston 44 to the locking mandrel 54. In the illustrative embodiment of the invention shown FIG. 2, for example, the THRT 10 comprises a number of resilient collet fingers 60 which are attached to the second locking piston 44 and which each comprise an enlarged head portion 62 that is biased into a corresponding groove 64 in the locking mandrel 54 to thereby releasably connect the locking mandrel to the second locking piston.

In accordance with the present invention, the electrically operated actuation tool further comprises at least one and preferably two electrical actuators to move the locking pistons 42, 44 between their unlocked and locked positions. In one embodiment of the invention, for example, the actuation tool comprises a first electrical actuator 66 to move the first locking piston 42 into and out of engagement with the first locking device and a second electrical actuator 68 to move the second locking piston 44 into and out of engagement with the second locking device. As will be made apparent below, the first and second electrical actuators 66, 68 are incorporated into the THRT 10.

As shown in FIG. 2, the first electrical actuator 66 includes an electric motor 70 which is coupled through a suitable transmission mechanism to the first locking piston 42. The motor 70 can be any suitable device which operates to convert electrical energy into work. The specific motor 70 chosen for the THRT 10 will be dictated by the size and configuration of the THRT 10, the forces required to actuate the first locking piston 42 and the specific transmission mechanism used to couple the motor to the first locking piston. Thus, the motor 70 can comprise any of a variety of rotary or linear motors or electromagnetic actuators. In addition, the motor 70 may be mounted on the body 34 of the THRT 10 or within a corresponding recess which is formed in the body.

In the embodiment of the invention shown in FIG. 2, the motor 70 comprises a rotary motor and the transmission mechanism includes a suitable gear train to convert the rotary output of the motor into axial translation of the first locking piston 42. In the illustrated embodiment of the invention, for example, the transmission mechanism includes a pinion 72 which is connected to the output shaft of the motor 70, a ring gear 74 which is rotatably supported on the body 34, and a sleeve 76 which is attached to or formed integrally with the first locking piston 42. The ring gear 74 comprises a threaded outer diameter surface and a geared inner diameter surface which engages the pinion 72, and the sleeve 76 comprises a threaded inner diameter surface which engages the threaded outer diameter surface of the ring gear. In addition, the first locking piston 42 is ideally keyed to the body 34 to prevent the first locking piston from rotating relative to the THRT 10. In this manner, rotation of the pinion 72 will rotate the ring gear 74 which, due to the threaded interface between the ring gear and the sleeve 76, will cause the first locking piston 42 to move axially on the body 34 to bring the first locking piston into or out of engagement with the first locking device.

The second electrical actuator 68 is ideally similar in construction and operation to the first electrical actuator 66. Thus, the second electrical actuator 68 preferably comprises a rotary motor 78 which is mounted on or in the body 34 of the THRT 10 and is coupled to the second locking piston 44 by a suitable transmission mechanism. In the embodiment of the invention shown in FIG. 2, for example, the transmission mechanism includes a pinion 80 which is connected to the output shaft of the motor 78, a ring gear 82 which is rotatably supported on the body 34, and a sleeve 84 which is attached to or formed integrally with the second locking piston 44. The ring gear 82 comprises a threaded outer diameter surface and a geared inner diameter surface which engages the pinion 80, and the sleeve 84 comprises a threaded inner diameter surface which engages the threaded outer diameter surface of the ring gear. In addition, the ring gear 82 preferably comprises an outer diameter surface which is keyed to the inner diameter surface of a tubular retainer 86 that is rigidly secured to the body 34 to thereby prevent the second locking piston 44 from rotating relative to the body. Thus, rotation of the pinion 80 will rotate the ring gear 82 which, due to the threaded connection between the ring gear and the sleeve 84, will cause the second locking piston 44 to move axially on the body 34 to bring the second locking piston into or out of engagement with the second locking device.

As an alternative to the embodiment of the invention shown in FIG. 2, the rotary motors 70, 78 may be replaced with one or more linear motors that are connected to their respective first and second locking pistons 42, 44 via a suitable transmission or mechanical linkage. For example, the output cylinder of each linear motor may be connected directly to a corresponding locking piston 42, 44, in which event activation of the motors will result in the direct actuation of the locking pistons. Alternatively, the output cylinder of each linear motor may be connected to its corresponding locking piston 42, 44 through one or more mechanical linkages. Other embodiments of the electrical actuators 66, 68 may be readily derived by the person of ordinary skill in the art from the above description and should therefore be considered to fall within the scope of the present invention.

Referring again to FIG. 1, the electrically operated actuation tool may also include a suitable power source for the motors 70, 78. For example, the actuation tool may include a battery pack 88 which is mounted on or within the body 34 of the THRT 10. The battery pack 88 is ideally sized to permit the motors 70, 78 to complete all of the operations required to install, service or retrieve the tubing hanger 12. However, the battery pack 88 may be trickle charged through a simple electrical cable which is connected to a suitable power supply on the surface rig and which, in the event that it is severed by the BOP rams 32, can be easily and inexpensively replaced.

The actuation tool may also comprise a control unit 90 to control the operation of the motors 70, 78. The control unit 90 may be mounted on or within the body 34 of the THRT 10 and is optimally activated remotely through, for example, acoustic telemetry signals which are generated by a transmitter 92 that is located on the surface rig 26. Thus, when used in conjunction with the battery pack 88, the control unit 90 permits the THRT 10 to operate without the need for an umbilical or any other such cables extending from the surface rig 26 which could interfere with the sealing ability of the BOP 22. Alternatively, the control unit 90 may be located on the surface rig 26 and its control signals transmitted to the motors 70, 78 via a simple electrical cable which, in the event it is severed by the BOP rams 32, is easy and inexpensive to replace. In yet another embodiment of the invention, both the power source 88 and the control unit 90 for the motors 70, 78 may be located on the surface rig 26 and connected to the motors via a replaceable electrical cable.

Figure 3:
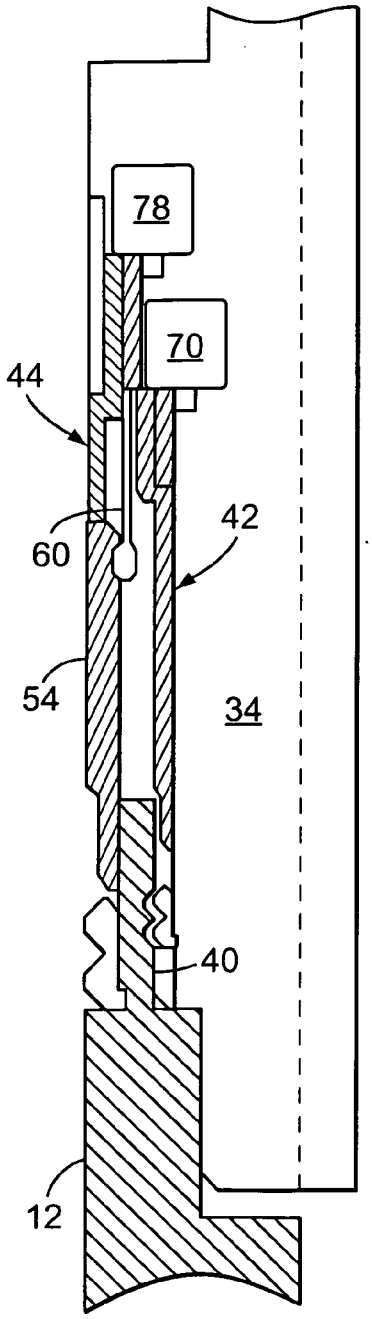
FIG. 3 is a partial cross sectional view of the THRT of FIG. 1 shown just prior to being secured to the tubing hanger.
Figure 4:
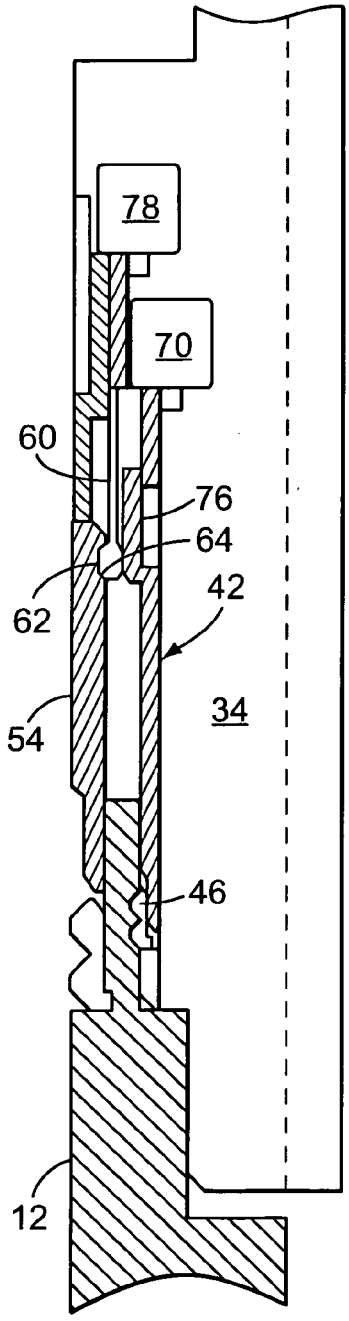
FIG. 4 is a partial cross sectional view of the THRT of FIG. 1 showing the first locking piston engaged with the first locking device to secure the THRT to the tubing hanger.

The operation of the THRT 10 will now be described with reference to FIG. 3 through 6. The THRT 10 is ideally designed to operate in a manner similar to prior art THRT's. Thus, with the first and second locking pistons 42, 44 both in their upper or unlocked positions, the THRT 10 is lowered into the receptacle 40 of the tubing hanger 12 until the collet fingers 60 engage the locking mandrel 54 (FIG. 3). The motor 70 is then activated to move the first locking piston 42 downward into engagement with the lock ring 46 to secure the THRT 10 to the tubing hanger 12 (FIG. 4). In this position, the outer diameter surface of the sleeve 76 will ideally trap the heads 62 of the collet fingers 60 into the groove 64 to ensure that the locking mandrel 54 will remain connected to the first locking piston 42 and in its raised or unlocked position as the tubing hanger 12 is lowered to the wellhead 14.

Figure 5:
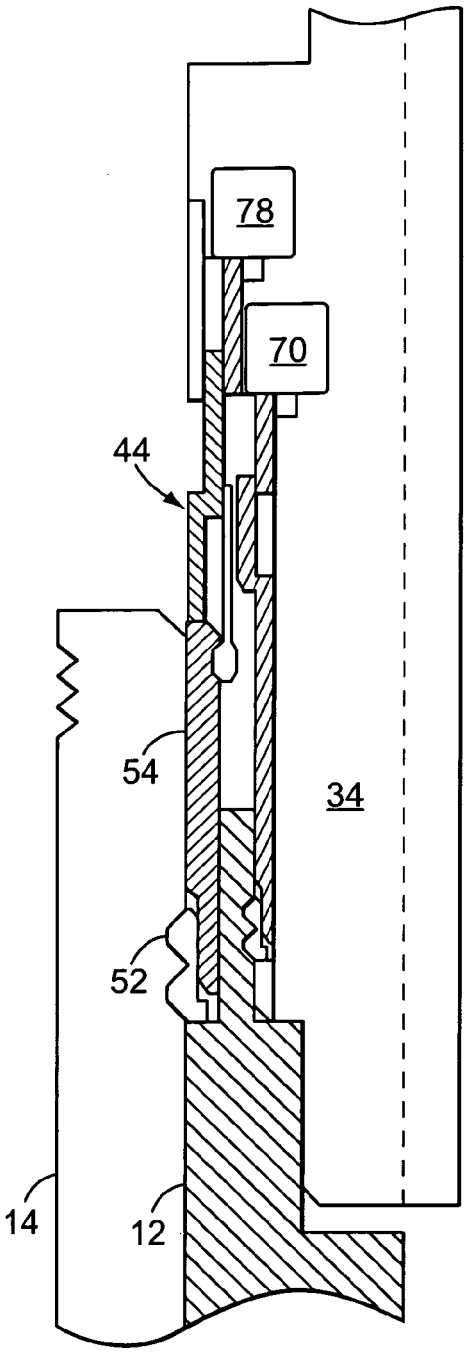
FIG. 5 is a partial cross sectional view of the THRT of FIG. 1 showing the second locking piston engaged with the second locking device to secure the tubing hanger to the wellhead housing.
Figure 6:
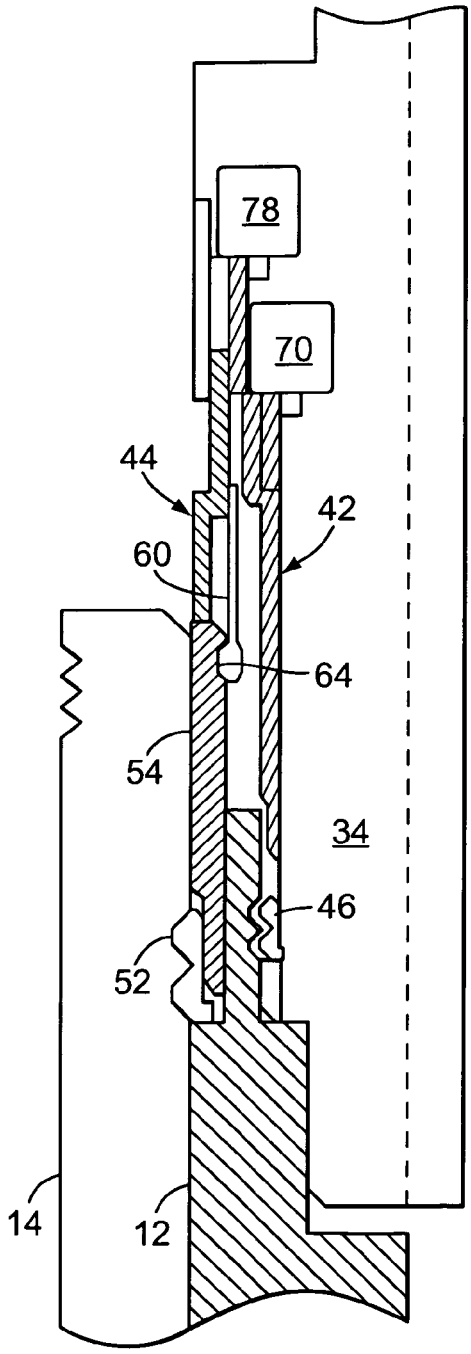
FIG. 6 is a partial cross sectional view of the THRT of FIG. 1 showing the first locking piston disengaged from the first locking device to release the THRT from the tubing hanger.

Once the tubing hanger 12 is landed in the wellhead 14, the motor 78 is activated to move the second locking piston 44 downward and force the locking mandrel 54 into engagement with the lock ring 52 to secure the tubing hanger to the wellhead (FIG. 5). After the tubing hanger 12 has been tested, the well bore circulated and any other required procedures completed, the motor 70 may again be activated to move the first locking piston 42 upward out of engagement with the lock ring 46 to thereby release the THRT 10 from the tubing hanger (FIG. 6). In this position, the second locking piston 44 may be disconnected from the mandrel 54 by simply pulling upward on the THRT 10, which action will release the collet fingers 60 from the groove 64. As a result, the mandrel 54 will remain in its lowered or locked position to maintain the tubing hanger 12 firmly secured to the wellhead 14. The THRT 10 may then be retrieved to the surface rig 26. Retrieval of the tubing hanger 12 from the surface rig 26 may be accomplished by reversing the above-described procedures.

In accordance with another embodiment of the present invention, the electrically operated actuation tool comprises an electrical motor and a hydraulic pump, both of which are incorporated into the subsea completion system component. The electrical motor drives the hydraulic pump to thereby generate hydraulic pressure which is used to actuate the subsea completion system component. This embodiment is particularly useful for subsea completion system components which are normally actuated hydraulically. Since these components typically include one or more hydraulically actuated mechanisms and corresponding hydraulic lines, they will require only minor modifications to work with the current embodiment of the invention. Although the actuation tool of this embodiment may be used with any of a variety of subsea completion system components, for purposes of simplicity it will be described in the context of a THRT.

Figure 7:
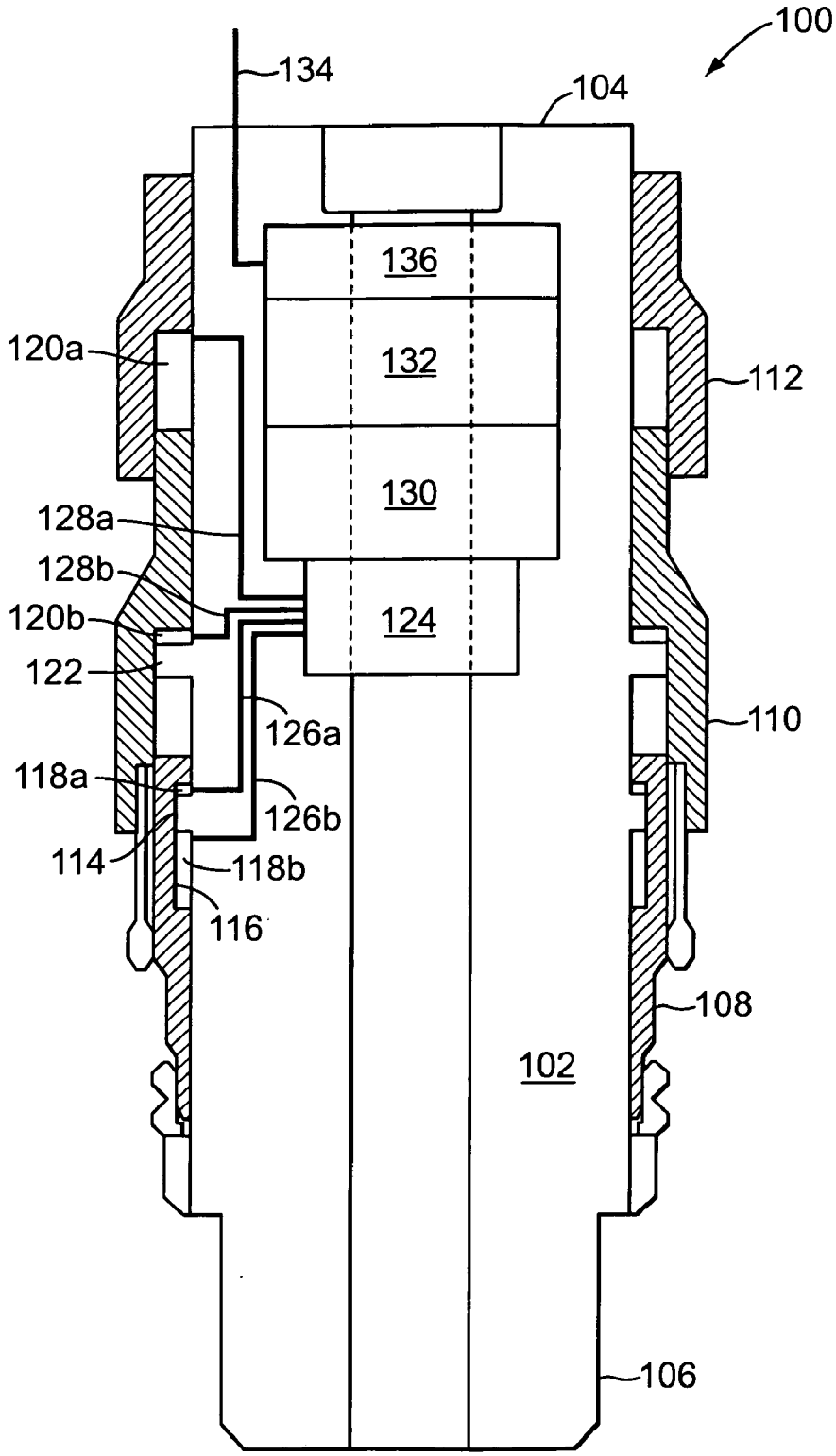
FIG. 7 is a representation of a second embodiment of the electrically operated actuation tool of the present invention shown incorporated into a schematically-illustrated THRT, wherein several components of the actuation tool are depicted schematically.

Accordingly, referring to FIG. 7, the electrically operated actuation tool is shown incorporated into a THRT 100. The THRT 100 is similar to a conventional THRT in that it comprises an elongated, generally annular body 102 which has an upper end 104 that may be secured to a suitable running string and a lower end 106 that is adapted to engage a tubing hanger. The THRT 100 also includes a first cylindrical locking piston 108 which is slidably supported on the body 102, a second cylindrical locking piston 110 which is slidably supported on the body above the first locking piston, and a retention sleeve 112 which is rigidly secured to the body above the second locking piston. Similar to the THRT 10 described above, the first locking piston 108 is adapted to engage a first locking device to secure the THRT to the tubing hanger, and the second locking piston 110 is adapted to engage a second locking device to secure the tubing hanger to a wellhead or the like.

The THRT 100 also includes a number of piston chambers to which hydraulic pressure is communicated in order to actuate the first and second locking pistons 108, 110. In the illustrative embodiment of the invention shown in FIG. 7, for example, a first radial flange 114 on the body 102 cooperates with a cylindrical recess 116 on the inner diameter of the first locking piston 108 to form a first sealed piston chamber **118*a* and a second sealed piston chamber 118*b*. Also, the retention sleeve 112 cooperates with the second locking piston 110 to define a third sealed piston chamber 120*a*, and the second locking piston cooperates with a second radial flange 122 on the body 102 to form a fourth sealed piston chamber 120*b*. The first and second radial flanges 114, 122 may either be formed integrally with the body 102** or comprise separate rings which are welded, threaded, press fit or otherwise attached to the body.

In operation of the THRT 100, hydraulic pressure is selectively supplied to the first piston chambers **118*a* to force the first locking piston 108 axially downward to thereby engage the first locking device, and hydraulic pressure is selectively supplied to the second piston chambers 118*b* to force the first locking piston axially upward to thereby disengage the first locking device. Likewise, hydraulic pressure is selectively supplied to the third piston chamber 120*a* to force the second locking piston 110 axially downward to thereby engage the second locking device, and hydraulic pressure is selectively supplied to the fourth piston chamber 120*b* to force the second locking piston axially upward to thereby disengage the second locking device. In this manner, the THRT 100** may be either locket to or unlocked from the tubing hanger, and the tubing hanger may be either locked to or unlocked from the wellhead.

The electrically operated actuation tool also comprises a hydraulic pump 124 for generating the hydraulic pressure which is supplied to the piston chambers 118*a*, 118*b*, 120*a* and 120*b*. The hydraulic pump 124 can be any suitable pump which is capable of generating hydraulic pressure, such as a gear pump, a piston pump or a rotary vane pump. The hydraulic pump 124 is fluidly connected to the first piston chamber 118*a* by a first fluid conduit 126*a*, to the second piston chamber 118*b* by a second fluid conduit 126*b*, to the third piston chamber 120*a* by a third fluid conduit 128*a* and to the fourth piston chamber 120*b* by a fourth fluid conduit 128*b*. Although not depicted in the drawings, a hydraulic circuit may be connected between the hydraulic pump 124 and the fluid conduits 126*a*, 126*b*, 128*a* and 128*b*. The hydraulic circuit may comprise a number of conventional hydraulic valves, switches or similar means for controlling the supply of hydraulic pressure to the piston chambers to selectively actuate the first and second locking pistons 108, 110. The design and operation of such a hydraulic circuit will be readily understood by the person of ordinary skill in the art.

The actuation tool further comprises an electric motor 130 for driving the hydraulic pump 124. The motor 130, which may be similar to any of the electric motors identified above, may be connected to the hydraulic pump 124 either directly or through a suitable gear box (not shown). In addition, although not illustrated in the drawings, the THRT 100 may include a motor controller for controlling, e.g., the output of the motor 130. The selection of an appropriate motor 130 for a given hydraulic pump 124, as well as the design of any required gear box and motor controller, are within the knowledge of the person of ordinary skill in the art.

The motor 130 may be energized by any suitable power source. For example, the actuation tool may include a battery pack 132 for supplying power directly to the motor 130. Although the battery pack 132 is preferably sufficiently sized to power the THRT 100 for the entirety of each operation which may be required of it, the battery pack may also be trickle charged over a suitable electrical cable 134 which is connected to a power supply located on the surface rig. Alternatively, all the energy required to power the motor 130 may be obtained from the power supply on the surface rig over a suitable electrical cable.

In either event, the actuation tool preferably also includes a control unit 136 for controlling the operation of the motor 130 and any hydraulic circuit within the THRT. The control unit 136 may be activated by signals which are transmitted over the cable 134 or a suitable dedicated cable. Alternatively, the control unit 136 may be activated by wireless signals, such as acoustic telemetry signals, which are generated by a transmitter similar to the transmitter 92 discussed above. Of course, the control unit 136 may be located on the surface rig, in which event the control signals may be transmitted to the motor 130 over the cable 134, over a dedicated cable, or via the wireless transmitter.

The hydraulic pump 124 and the motor 130, and if present the battery pack 132 and the control unit 136, may be mounted either on the exterior of the body 102 of the THRT 100 or within one or more recesses which are formed in the body. Alternatively, one or more of these components may be housed in a separate structure which is connected between the running string and the upper end 104 of the body 102.

Thus, by incorporating the electrically operated actuation tool into the THRT 100, the need for an umbilical to transmit hydraulic pressure from the surface rig to the THRT is eliminated. Furthermore, if the THRT 100 also includes the battery pack 132, operation of the THRT will at most require a simple electrical cable 134 to transmit control signals to the motor 130 and, if desired, to trickle charge the battery pack. However, if the THRT 100 includes the control unit 136 and the control signals are transmitted wirelessly to the control unit, the electrically operated actuation tool eliminates the need for any cables between the surface rig and the THRT.

In accordance with another embodiment of the present invention, the electrically operated actuation tool is housed separately from the subsea completion system component with which it is intended to be used. As a result, the actuation tool may be used with a conventional hydraulically actuated subsea completion system component. In addition, the same actuation tool may be used with a number of different subsea completion system components. For purposes of simplicity, however, the actuation tool of this embodiment of the invention will be described in connection with a THRT.

Figure 8:
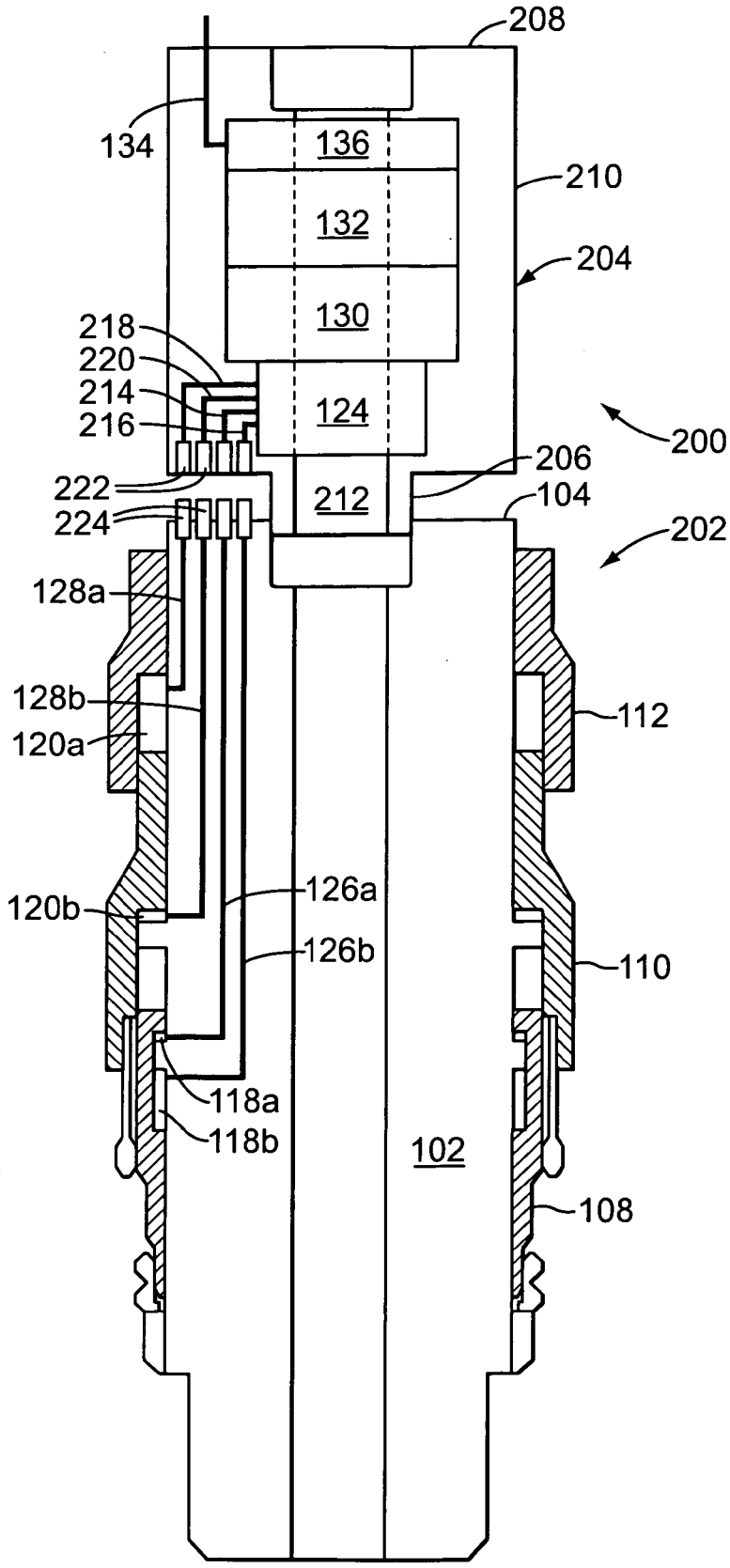
FIG. 8 is a representation of yet another embodiment of the electrically operated actuation tool of the present invention, wherein several components of the actuation tool are depicted schematically.

Referring to FIG. 8, the electrically operated actuation tool, generally 200, is shown positioned above an exemplary THRT 202. The THRT 202 is similar in many respects to the THRT 100 described above in that it comprises a cylindrical body 102, a first locking piston 108, a second locking piston 110, a retention sleeve 112, and first, second, third and fourth sealed piston chambers 118*a*, 118*b*, 120*a* and 120*b*, respectively. In addition, hydraulic pressure is communicated to the piston chambers 118*a*, 118*b*, 120*a* and 120*b* through corresponding first, second, third and fourth fluid conduits 126*a*, 126*b*, 128*a* and 128*b*. However, as with a conventional THRT, the THRT 202 does not comprise a source of hydraulic pressure. Instead, hydraulic pressure is supplied to the THRT 202 from an external source.

In accordance with the current embodiment of the present invention, the actuation tool 200 comprises this external source of hydraulic pressure. The actuation tool 200 thus includes a body 204 which comprises a lower end 206 that is adapted to be secured to the upper end 104 of the THRT 202, an upper end 208 that is releasably connectable to a deployment device, such as a conventional running string or a remotely operated vehicle ("ROV"), and an outer diameter surface 210 that is ideally sealingly engageable by the rams of a BOP. In addition, the body 204 may be provided with an axial bore 212 through which well fluids or the like may be communicated. The body 204 may be constructed of any suitable material, such as metal or, if the actuation tool 200 is to be deployed by an ROV, preferably plastic.

The actuation tool 200 also includes several of the components of the actuation tool described above in connection with the THRT 100, such as a hydraulic pump 124 for generating hydraulic pressure and an electric motor 130 for driving the hydraulic pump. Also, the actuation tool 200 may include a battery pack 132 for supplying power to the motor 130 and a control unit 136 for controlling the operation of the motor. The selection, arrangement and operation of these components are preferably as described above in connection with the actuation tool for the THRT 100. In addition, these components are ideally housed within the body 204 so that they may be protected from the subsea environment.

The actuation tool 200 further comprises suitable means for communicating the hydraulic pressure from the hydraulic pump 124 to the fluid conduits 126*a*, 126*b*, 128*a* and 128*b* in the THRT 202. In the embodiment of the invention illustrated in FIG. 8, for example, the actuation tool includes at least first, second, third and fourth hydraulic lines 214, 216, 218 and 220, respectively, which each extend between the hydraulic pump 124 and a corresponding hydraulic coupling member 222. The coupling members 222 are adapted to sealingly engage corresponding coupling members 224, each of which is connected to a respective one of the fluid conduits 126*a*, 126*b*, 128*a* and 128*b*. In this manner, when the actuation tool 200 is engaged with the THRT 202, the coupling members 222 and 224 will fluidly connect each of the hydraulic lines 214, 216, 218 and 220 with a corresponding one of the fluid conduits 126*a*, 126*b*, 128*a* and 128*b*. The coupling members 222, 224 may include poppet-type valves to retain the hydraulic pressure within the hydraulic lines and the fluid conduits when the actuation tool 200 is disengaged from the THRT 202. Of course, any other suitable means may be used to releasably connect the hydraulic lines 214, 216, 218 and 220 with the fluid conduits 126*a*, 126*b*, 128*a* and 128*b*, such as conventional stabs.

In operation, the electrically operated actuation tool 200 may be connected between the THRT 202 at the surface rig and then lowered to the subsea wellhead on a running string. In this event, the actuation tool 200 is operated in a manner similar to that described above in connection with the THRT 100 to, e.g., secure the THRT 202 to the tubing hanger and then lock the tubing hanger to the wellhead. Alternatively, if the THRT 202 is already in position in the wellhead, the actuation tool 200 may be deployed independently of the THRT 202, either on a running string from the surface rig or by an ROV from a location proximate the wellhead. In this event, the actuation tool 200 is secured to the THRT 202 so that the hydraulic lines 214, 216, 218 and 220 are fluidly connected with the fluid conduits 126*a*, 126*b*, 128*a* and 128*b*. Thereafter, the actuation tool 200 may be operated in a manner similar to that described above in connection with the THRT 100 to, e.g., secure the THRT 202 to the tubing hanger and release the tubing hanger from the wellhead so that the tubing hanger may be retrieved to the surface rig.

Although the electrically operated actuation tool 200 has been described in connection with a THRT, it may also be used to actuate other wellhead components. For example, the actuation tool 200 may be used to actuate one or more valves or similar devices which are located on the wellhead, in the tubing hanger, or downhole in the well bore. The person of ordinary skill in the art will readily understand how to adapt the actuation tool 200 for these and other applications.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. An actuation tool for a tubing hanger running tool (THRT) which includes at least one hydraulic locking piston, a piston chamber which is disposed adjacent the locking piston and a fluid conduit which conveys hydraulic fluid to the piston chamber, the actuation tool comprising:

a body which is releasably connectable to an upper end of the THRT;

an electric motor which is supported on the body;

a hydraulic pump which is supported on the body and is driven by the motor;

at least one hydraulic line which is connected to the hydraulic pump; and means for releasably coupling the hydraulic line with the fluid conduit when the body is connected to the THRT;

wherein the motor drives the hydraulic pump to generate hydraulic pressure which, when the body is connected to the THRT, is conveyed through the hydraulic line and the fluid conduit to the piston chamber to actuate the locking piston.

2. The actuation tool of claim 1, further comprising a power source for the motor.

3. The actuation tool of claim 2, wherein the power source comprises a battery.

4. The actuation tool of claim 3, wherein the battery is supported on the body.

5. The actuation tool of claim 4, wherein the battery is trickle charged over an electrical cable which is connected to a power supply located on a surface rig.

6. The actuation tool of claim 2, wherein the power source is located on a surface rig and is connected to the motor by an electric cable.

7. The actuation tool of claim 2, further comprising a control unit for controlling the operation of the motor.

8. The actuation tool of claim 7, wherein the control unit is activated by control signals transmitted from a surface rig.

9. The actuation tool of claim 8, wherein the control signals are transmitted over a cable which extends between the surface rig and the control unit.

10. The actuation tool of claim 8, wherein the control signals are transmitted wirelessly from the surface rig to the control unit.

11. The actuation tool of claim 1, wherein the body comprises a first axial bore through which well fluids may be communicated.

12. The actuation tool of claim 11, wherein the first axial bore communicates with a second axial bore which extends through the THRT.

13. The actuation tool of claim 1, wherein the body comprises an outer surface which is engageable by one or more BOP rams.

14. The actuation tool of claim 1, wherein the coupling means comprises a stab.

15. The actuation tool of claim 1, wherein the coupling means comprises a poppet valve.

16. An electrically operated tubing hanger running tool (THRT) for installing a tubing hanger in a wellhead or the like, the THRT comprising:

an elongated body which includes a first end that is position adjacent the tubing hanger and a second end that is connected to a running string;

at least first and second locking pistons which are each movably supported on the body; and an electrically operated actuator for moving each of the first and second locking pistons between respective first and second unlocked and first and second locked positions;

wherein in the first locked position the first locking piston is engaged with a first locking device to secure the body to the tubing hanger;

wherein in the second locked position the second locking piston is engaged with a second locking device to secure the tubing hanger to the wellhead;

wherein the electrically operated actuator comprises at least one electrical actuator.

17. The THRT of claim 16, wherein the electrical actuator comprises a first electric motor which is coupled to the first locking piston and a second electric motor which is coupled to the second locking piston.

18. The THRT of claim 17, wherein each of the first and second electric motors comprises a rotary motor.

19. The THRT of claim 18, further comprising means for converting the rotary output of each of the first and second motors into axial translation of the corresponding first and second locking piston.

20. The THRT of claim 16, further comprising a power source for the electrically operated actuator.

21. The THRT of claim 20, wherein the power source comprises a battery.

22. The THRT of claim 21, wherein the battery is supported on the body.

23. The THRT of claim 22, wherein the battery is trickle charged over an electrical cable which is connected to a power supply located on a surface rig.

24. The THRT of claim 20, wherein the power source is located on a surface rig and is connected to the electrically operated actuator by an electric cable.

25. The THRT of claim 20, further comprising a control unit for controlling the operation of the electrically operated actuator.

26. The THRT of claim 25, wherein the control unit is activated by control signals transmitted from a surface rig.

27. The THRT of claim 26, wherein the control signals are transmitted over a cable which extends between the surface rig and the control unit.

28. The THRT of claim 27, wherein the control signals are transmitted wirelessly from the surface rig to the control unit.

* * * * *